United States Patent [19]

Harms et al.

[11] Patent Number: 5,044,773

[45] Date of Patent: Sep. 3, 1991

[54] CONTAINER FOR RECEIVING AND HOLDING AN OBJECT INCLUDING SUPPORT MEMBER THEREFOR

[75] Inventors: William Harms, Park Ridge; James Howell, Sr., Woodcliff Lake; Richard Cypranowski, Fair Lawn, all of N.J.

[73] Assignee: Berwick Industries Inc., Paramus, N.J.

[21] Appl. No.: 510,780

[22] Filed: Apr. 18, 1990

[51] Int. Cl.[5] ..... B65D 3/28

[52] U.S. Cl. ..... 383/22; 206/806; 383/27

[58] Field of Search ..... 383/22, 24, 27; 206/806

[56] References Cited

U.S. PATENT DOCUMENTS

| | | | |
|---|---|---|---|
| 2,363,926 | 11/1944 | Arens | 383/22 |
| 2,983,087 | 5/1961 | Schofield | 206/806 |
| 3,437,117 | 4/1969 | Vitello et al. | 383/22 |
| 3,549,085 | 12/1970 | Hart | 383/22 |
| 4,101,104 | 7/1978 | Minard | 383/22 |
| 4,385,722 | 5/1983 | Brewill | 206/806 |
| 4,521,911 | 6/1985 | Vance | 383/24 |
| 4,590,610 | 5/1986 | Rhyne | 206/806 |
| 4,715,728 | 12/1987 | Sfikas | 383/22 |
| 4,764,028 | 8/1988 | Wood et al. | 206/806 |

OTHER PUBLICATIONS

Photographs of Prior Art Bag.

*Primary Examiner*—Gary E. Elkins

*Attorney, Agent, or Firm*—Panitch Schwarze Jacobs & Nadel

[57] ABSTRACT

A container for receiving and holding an object comprises generally parallel front and rear panels, generally parallel side panels, and a bottom panel, the edges of the front, rear and side panels being joined together and being joined with the bottom panel to form a generally bag-like container with an open top. The top edges of the front, rear and side panels are folded toward the bottom panel to form a reinforcing cuff proximate the open top of the container. A support member includes a first portion installed within the cuff and a second portion extending from the first portion out of the cuff and beyond the top of the container. The second support member portion includes an opening for receiving a supporting member for supporting the container in a hanging condition.

5 Claims, 2 Drawing Sheets

CONTAINER FOR RECEIVING AND HOLDING AN OBJECT INCLUDING SUPPORT MEMBER THEREFOR

BACKGROUND OF THE INVENTION

The present invention relates generally to a container for receiving and holding an object and, more particularly, to such a container which includes a removable support member.

In recent years, there has been a tremendous growth in the manufacture and sale of containers, particularly decorative containers for receiving and holding objects, particularly gift objects. One form of such containers is a decorative bag which is adapted to receive a gift item such as a stuffed animal, decorative craft object, or the like. Employing decorative bags of this nature obviates a need for a separate box, as well as the use of wrapping paper, ribbons, bows, etc. Decorative bags of this nature facilitate the purchase of a gift item, as well as the decorative bag, at the same location, thereby making it much easier to give such gifts.

The present invention relates to a decorative bag which includes a support member to facilitate supporting the decorative bag on a display rack or other supporting means for convenient display. In addition, the support member permits the decorative bag to be displayed with a gift product inside in order to stimulate sales both of the gift product and the decorative bag.

SUMMARY OF THE INVENTION

Briefly stated, the present invention comprises a container for receiving and holding an object, such as a gift object. The container comprises generally front and rear panels each having generally parallel top and bottom edges and generally parallel lateral edges. A pair of generally parallel side panels each also having generally parallel top and bottom edges and generally parallel lateral edges are provided. A bottom panel is provided with two pairs of generally parallel edges, the lateral edges of the front and rear panels being joined to the lateral edges of the side panels and the bottom edges of the front, rear and side panels being joined to the edges of the bottom panel to form a container having a generally open top. The top edges of the front, rear and side panels are folded toward the bottom panel to form a reinforcing cuff of a predetermined width proximate the open top of the container. The container includes a support member comprised of a first portion installed within the cuff and a second portion extending from the first portion, out of the cuff and beyond the top of the container. The second portion includes means for receiving a supporting member for supporting the container in a hanging condition.

BRIEF DESCRIPTION OF THE DRAWINGS

The foregoing summary, as well as the following detailed description of a preferred embodiment of the invention, will be better understood when read in conjunction with the appended drawings. For the purpose of illustrating the present invention, there is shown in the drawings an embodiment which is presently preferred. It should be understood, however, that the present invention is not limited to the particular arrangement and instrumentalities shown. In the drawings.

DESCRIPTION OF PREFERRED EMBODIMENT

Figure 1:
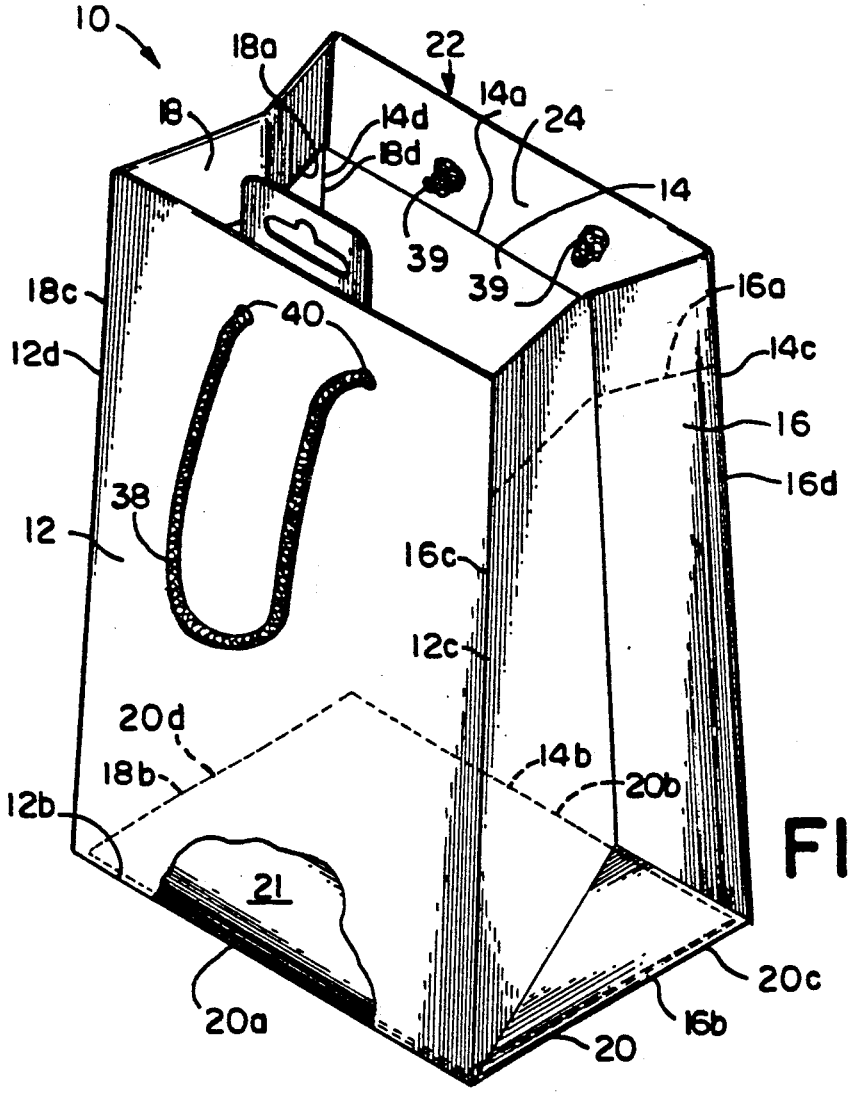
FIG. 1 is a perspective view of a container which includes a support member in accordance with the present invention.

Referring to the drawings, wherein like numerals indicate like elements throughout, there is shown in FIG. 1 a container, generally 10, in accordance with the present invention. In the embodiment illustrated in FIG. 1 the container 10 is in the form of a bag of the type which includes a generally flat bottom and which is generally self-supporting when in the open condition as illustrated in FIG. 1.

The bag 10 includes generally parallel front and rear panels 12 and 14, both of which are generally rectangularly shaped and both of which are generally the same size. It should be understood that while the front and rear panels 12 and 14 in the present embodiment are generally rectangular, they could be of some other shape, such as square. The front panel 12 includes generally parallel top and bottom edges 12*a* and 12*b* which are substantially the same in length. The front panel 12 further includes a pair of generally parallel lateral edges 12*c* and 12*d* which are also generally the same in length and which extend between and interconnect with the front panel top and bottom edges 12*a* and 12*b*. The rear panel 14 includes similarly located, generally parallel top and bottom edges 14*a* and 14*b* and generally parallel lateral edges 14*c* and 14*d*.

The bag 10 further includes a pair of generally parallel side panels 16 and 18, each also being generally rectangular in the present embodiment and having generally parallel top and bottom edges 16*a*, 18*a*, and 16*b*, 18*b*, respectively, as well as generally parallel lateral edges 16*c*, 18*c*, and 16*d*, 18*d*. As with the front and rear panels 12 and 14, the length of the top and bottom edges of the side panels are generally the same. Similarly, the length of the lateral edges of the side panels 16 and 18 are generally the same and generally correspond to the lengths of the lateral edges of the front and rear panels 12 and 14.

The bag 10 further includes a generally rectangular bottom panel 20 which includes two pairs of generally parallel edges 20*a*, 20*b* and 20*c*, 20*d*. The first pair of bottom panel edges 20*a* and 20*b* generally correspond in length to the length of the front and rear panel bottom edges 12*b* and 14*b*. Similarly, the other pair of bottom panel edges 20*c* and 20*d* generally correspond in length to the length of the side panel bottom edges 16*b* and 18*b*.

The bag 10 is formed with the front and rear panel lateral edges 12*c*, 14*c* and 12*d*, 14*d* being joined to the corresponding side panel lateral edges 16*c*, 18*c* and 16*d*, 18*d* as illustrated in FIG. 1. Similarly, the bottom edges of the front, rear and side panels 12*b*, 14*b*, 16*b* and 18*b* are joined to the respective edges of the bottom panel 20*a*, 20*b*, 20*c* and 20*d* as also illustrated in FIG. 1. When the front panel 12, rear panel 14, side panels 16 and 18 and bottom panel 20 are joined together in this manner, the bag 10 is formed with a generally open top 22. It will be appreciated by those skilled in the art that the bag 10, as described, could be of the generally rectangular shape as shown or could be of some other shape. For example, the bag 10 could be of the type in which the front panel, rear panel and side panels are all generally square and of the same size to form a bag which is generally square. Similarly, while it is preferred that the bag 10 be formed of a single blank, other methods of constructing the bag may be employed.

In the presently preferred embodiment, the bag 10 is formed of a relatively lightweight paper base material to which has been applied an outer reinforcing coating or surface (not shown). Preferably, the outer surface of the bag comes in a variety of colors and may include a variety of different types of decorative arrangements (not shown) in order to make the bag attractive. For example, if the bag were to be employed for holding a stuffed animal, such as a teddy bear, the outer surface of the bag may be decorated in a bright background color with similar representative stuffed animals, such as teddy bears. Alternatively, if the bag is to contain a more adult oriented gift item, such as a gourmet kitchen implement, the outer surface of the bag may be decorated accordingly.

Preferably, once the bag is formed with the various panels joined as described above, portions of the top edges of each of the front, rear and side panels 12, 14, 16, 18 are folded generally inwardly and downwardly, toward the bottom panel 20 to form a reinforcing cuff 24 of a predetermined width as best illustrated in FIG. 1. Preferably, the reinforcing cuff 24 has a width of about three inches. The reinforcing cuff 24 is employed for reinforcing the upper portion of the bag 10 to facilitate attachment and use of handles in a manner which will hereinafter become apparent. The bag 10 may also include a bottom stabilizer member 21 formed of paperboard, cardboard or the like, which is installed loosely in the bottom of the bag, as shown.

Figure 3:
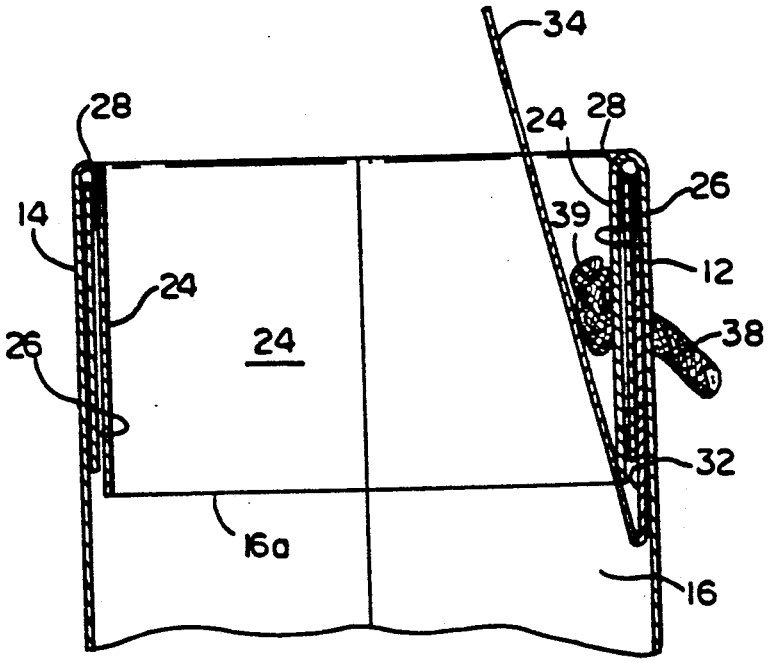
FIG. 3 is an enlarged sectional view of a portion of the container taken along line 3—3 of FIG. 2.

In the bag illustrated in FIG. 1, a separate reinforcing member 26 is installed within the reinforcing cuff 24 proximate both the front panel 12 and the rear panel 14. Each reinforcing member 26 which, in the present embodiment, is formed of a heavy paperboard or cardboard material, is generally rectangular in shape with a length generally corresponding to the width of the front and rear panels 12 and 14 and with a width which is at least slightly less than a width of the reinforcing cuff 24. In this manner, each of the reinforcing members 26 may be captured or retained within the reinforcing cuff 24. It is appreciated by those skilled in the art that the reinforcing members 26 may be formed of some other material, such as plastic, and may be of a different shape if desired. As best seen in FIG. 3, an adhesive 28 of a type suitable for use with the materials employed to form the bag 10 may be employed to secure the reinforcing members 26 to the reinforcing cuff 24 or directly to the front or rear panels 12, 14 (not illustrated) in order to help retain the reinforcing member 26 within the reinforcing cuff 24. If desired, the edge of the reinforcing cuff may be secured to the front and/or rear panels 12, 14.

Figure 4:
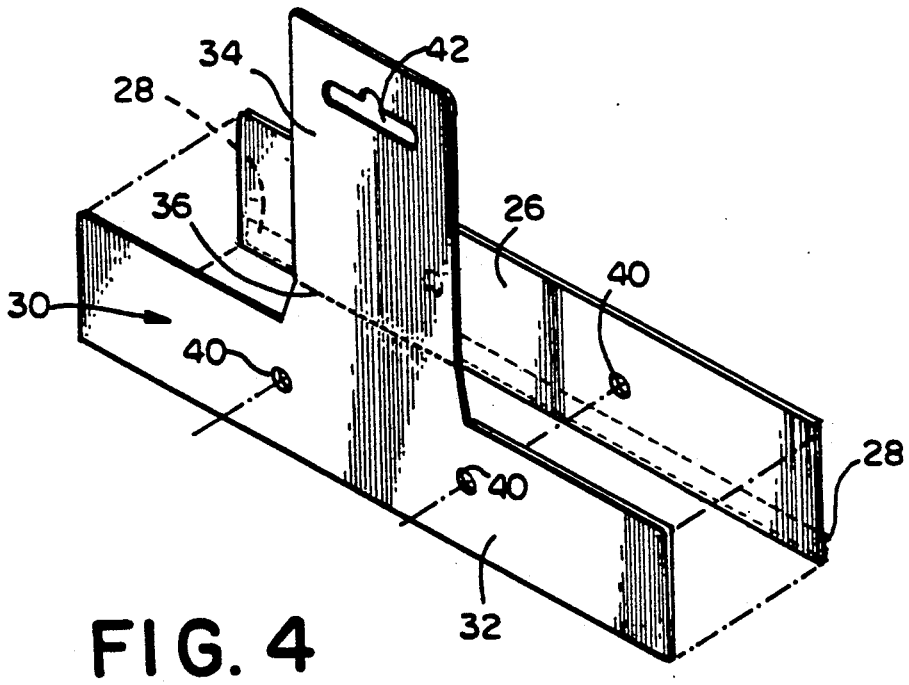
FIG. 4 is a perspective view of a support member and a reinforcing member of the type employed in the container of FIG. 1.

The bag 10 further includes a support member 30 for supporting the bag on a supporting means or member, such as a rack or other such display device (not illustrated), usually at a point of purchase. The support member 30, which is shown in FIG. 4 in an inverted position, includes a first portion 32 which is installed within the reinforcing cuff 24 in the manner shown in FIGS. 2 and 3. In the illustrated embodiment, the first support member portion 32 is generally rectangularly shaped with a length generally corresponding to the width of the front panel 12 and with a width at least slightly less than the width of the reinforcing cuff 24. Thus, the first support member portion 32 is generally about the same size as the reinforcing member 26.

Figure 2:
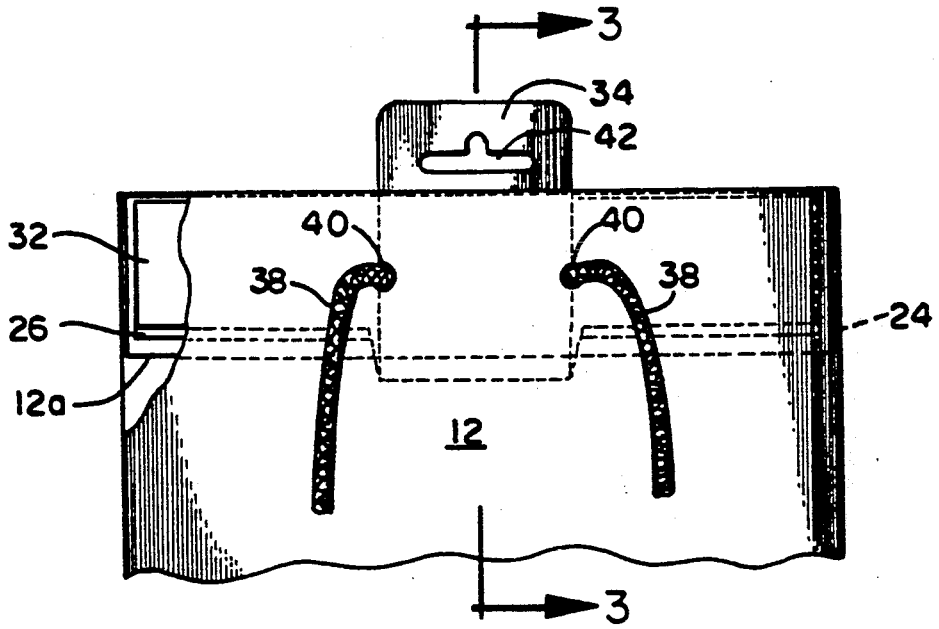
FIG. 2 is a front elevational view, partially broken away, of a portion of the container of FIG. 1.

The support member 30 also includes a second portion 34 which is removably secured to the first portion 32. In the embodiment illustrated, the second support member portion 34 is also generally rectangular in shape and has a width which is illustrated as being approximately one fourth of the length of the first portion 32. As best seen in FIGS. 2 and 3, the length of the second support member portion 34 is dictated by the width of the reinforcing cuff 24 in that it must be long enough to extend out of the cuff and upwardly at least slightly beyond the open top 22 of the bag 10 as illustrated.

In the presently preferred embodiment, the support member 30 is formed of a heavy paperboard or cardboard material. Preferably, the support member 30 is perforated along line 36 between the first support member portion 32 and the second support member portion 34 to facilitate separation and removal of the second support member portion 34 once the bag 10 has been purchased by an end user. It will be appreciated by those skilled in the art that the support member 30 could alternatively be formed of some other material, such as plastic, and that all or portions of the support member 30 may be formed into any other suitable shape.

As best shown in FIGS. 2 and 3, the first support member portion 32 is positioned within the reinforcing cuff 24 in an orientation which is inverted from that shown in FIG. 4. Because of the size of the first support member portion 32, the second support member portion 34 extends beyond the lower edge of the reinforcing cuff 24. The second support member portion 34 is then bent upwardly along the line 36 formed by the perforations, as illustrated in FIG. 3. If desired, a suitable adhesive 28 may be employed to secure the first support member portion 32, either to the front panel 12 or to the reinforcing member 26 proximate the front panel 12. If desired, the reinforcing member 26 proximate the front panel 12 may be eliminated with the first support member portion 32 functioning as a reinforcing member.

The bag 10 further preferably includes a pair of handles 38 which are preferably also decorative in nature. In the embodiment illustrated, each of the handles is comprised of a predetermined length of cord material, preferably a decorative yarn of a type and of a color which is coordinated with the decorative outer surface of the bag 10 to provide an aesthetically pleasing container. In the embodiment illustrated, the handles are secured to both the front and rear panels 12 and 14 in the area of the reinforcing cuff 24 in a manner well known in the bag art. Preferably, a pair of generally spaced, aligned, generally circular openings 40 extend through both the front and rear panels 12 and 14, through the corresponding reinforcing members 26 and through the reinforcing cuff 24. In the case of the front panel 12, the openings 40 also extend through the first support member portion 32. The ends of the yarn extend through the openings 40 in the manner illustrated and each of the ends is formed into a knot 39, preferably of a size greater than the openings 40. In this manner, the ends of the decorative yarn are captured to form the handles 38. Of course, it will be appreciated by those skilled in the art that any other suitable type of handle may alternatively be employed. Preferably, the spacing between the openings 40 is at least slightly greater than the width of the second support member portion 34 in order to permit the second support member portion 34 to extend upwardly between the knots on the ends of the handles 38 in the manner illustrated in FIG. 2.

The second support member portion 32 includes means for receiving a supporting member for supporting the container in a hanging condition. In the embodiment illustrated in FIG. 1, the means for receiving a supporting member comprises a generally slot-like opening 42 which extends completely through the second support member portion 34 at a location at least slightly above the open top 22 of the bag 10. The opening 42 is suitable for receiving a generally curved metallic supporting member (not shown), typically of the type employed in a standard commercial display rack (not shown). It will be appreciated by those skilled in the art that the opening 42 may be of any other shape, size or configuration as may be required for use with any particular type of supporting member or device.

The support member 30 permits the bag 10 to be supported in a generally open condition, as illustrated in FIG. 1. In this manner, a merchant may insert an object into the bag 10 and support the bag and the object on a standard display rack without having to use the handles 38. Supporting the bag 10 in this manner is desirable in that it permits the bag and the object contained therein to be clearly displayed without the handles 38 blocking the clear view of the displayed object. In addition, when supporting the bag 10 by the handles 38, the top portion of the bag tends to close, thereby possibly further reducing the ability to clearly display any object contained in the bag. As previously discussed, once the bag 10 (and the object contained therein) have been purchased, the second support member portion 34 may be conveniently removed and discarded by simply tearing along the perforated line 36. In this manner, the support member 30 does not interfere with the aesthetics of the bag 10 after purchase.

From the foregoing description, it can be seen that the present invention comprises a container or bag for receiving and holding an object and which contains a support member for supporting both the bag and the object for display. It will be appreciated by those skilled in the art that changes and modifications may be made to the above-described embodiment without departing from the inventive concepts thereof. Therefore, it is understood that the present invention should not be limited to the particular embodiment disclosed, but should include all modifications and changes which are within the scope and spirit of the invention as defined by the claims.

What is claimed is:

1. A container for receiving and holding an object comprising:

generally parallel front and rear panels each having generally parallel top and bottom edges and generally parallel lateral edges;

a pair of generally parallel side panels each having generally parallel top and bottom edges and generally parallel lateral edges;

a bottom panel having two pairs of generally parallel edges, the lateral edges of the front and rear panels being joined to the lateral edges of the side panels and the bottom edges of the front, rear and side panels being joined to the edges of the bottom panel to form a container having an open top, the top edges of the front, rear and side panels being folded toward the bottom panel to form a reinforcing cuff of a predetermined width proximate the open top of the container;

a support member comprised of a first portion installed within the cuff and a second portion extending from the first portion out of the cuff and beyond the top of the container, the second portion including means for receiving a supporting member for supporting the container in a hanging condition.

2. The container as recited in claim 1, wherein the first portion of the support member has a width generally corresponding to the width of the cuff and a length generally corresponding to the width of the front panel.

3. The container as recited in claim 1, wherein the means for receiving a supporting member comprises an opening extending through the second portion of the support member.

4. The container as recited in claim 1, wherein the first and second portions of the support member are separable to permit removal of the second portion.

5. The container as recited in claim 1, wherein the container further includes a pair of handles, one handle secured to the front panel and the other handle secured to the rear panel.

* * * * *